United States Patent [19]

Dee

[11] 4,033,521

[45] July 5, 1977

[54] WINDING MACHINES

[76] Inventor: Anthony Neiman Dee, Kenwood Lee, Sheldon Avenue, Highgate, London, England

[22] Filed: Dec. 5, 1975

[21] Appl. No.: 638,275

[30] Foreign Application Priority Data

Nov. 7, 1975 United Kingdom ..... 46211/75

[52] U.S. Cl. ..... 242/56 A; 242/56.2

[51] Int. Cl.[2] ..... B65H 19/26; B65H 35/02

[58] Field of Search ..... 242/56 A, 56.2, 56.6, 242/56.7, 64, 56.9, 58.1, 58.2, 58.3, 58.4, 25 A, 56.3, 56.4, 56.5

[56] References Cited

UNITED STATES PATENTS

| | | | |
|---|---|---|---|
| 2,620,141 | 12/1952 | Langbo | 242/56 A |
| 2,681,771 | 6/1954 | Haskell | 242/56 A |
| 2,772,054 | 11/1956 | Herele et al. | 242/56 A |
| 2,942,796 | 9/1960 | Gurney et al. | 242/56 A |
| 3,157,371 | 11/1964 | Billingsley | 242/56.2 |

FOREIGN PATENTS OR APPLICATIONS

| | | | |
|---|---|---|---|
| 1,135,005 | 11/1968 | United Kingdom | 242/56.9 |
| 904,144 | 8/1962 | United Kingdom | 242/56.9 |

*Primary Examiner*—George F. Mautz
*Attorney, Agent, or Firm*—Rudolph J. Jurick

[57] ABSTRACT

A center shaft turret winder is provided with core change-over mechanism, so that rewinding of webs e.g. in a slitter-rewinder can proceed continuously, by replacing full cores with empty cores and severing the wound webs between the respective cores. The mechanism includes a knife member which pivots about an axis parallel to the center shaft axis to bring its cutting edge into contact with the moving webs, after the core shafts have rotated around the center shaft, so that the tension in the webs increases and they are severed so that rewinding continues on the new cores and the old, full cores can be removed and replaced with empty cores. A paper printing and slitting machine equipped with such a slitter/rewinder and change-over mechanism is disclosed, together with the electromagnetic clutch arrangements for driving the winding cores and various forms of knife member.

12 Claims, 15 Drawing Figures

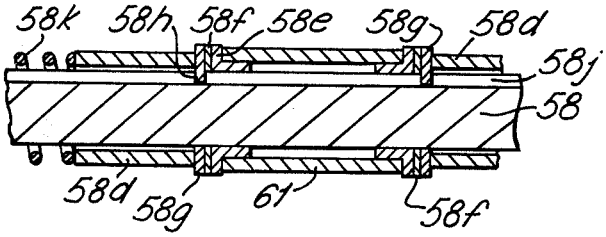
FIG.3A.
FIG.3.
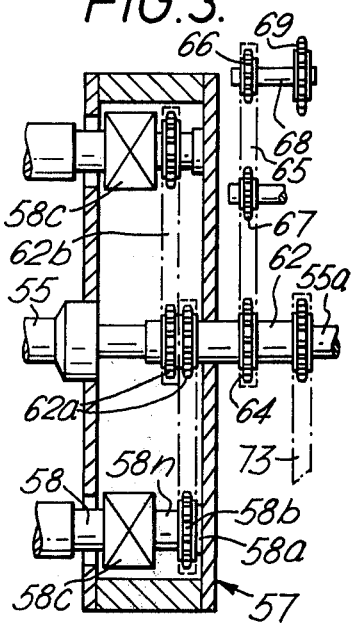
FIG.4.
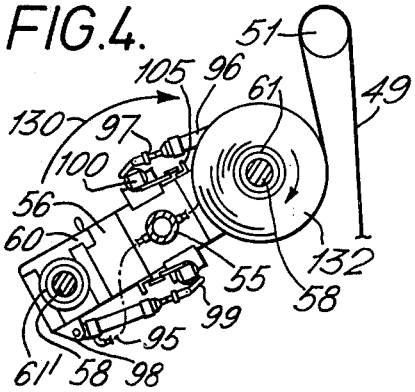
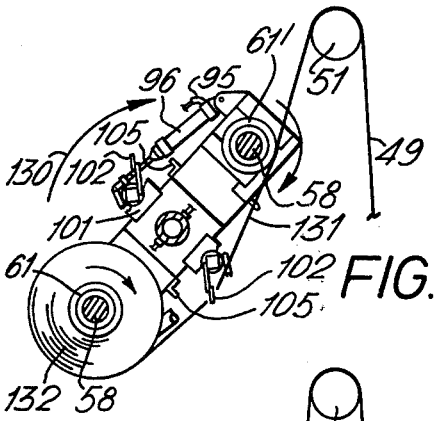
FIG.5.
FIG.5A.
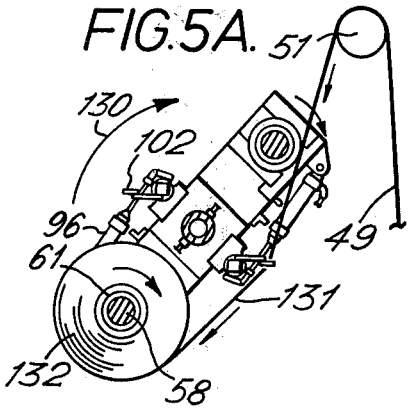
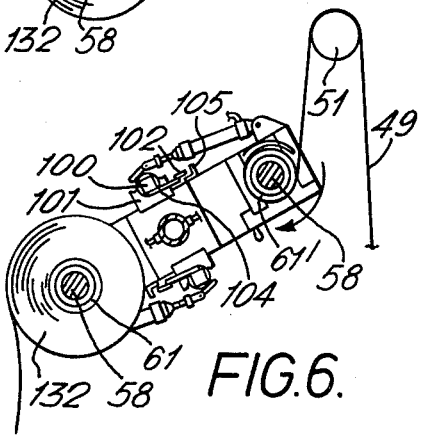
FIG.6.

WINDING MACHINES

This invention relates to winding machines for forming wound reels of paper and other webs upon tubular cores, such as slitter/winder machines, and is concerned in particular with change-over equipment for continuing winding upon one or more empty cores, after the core or cores being wound have been filled.

According to this invention, a core change-over arrangement for a turret winder machine having a centre shaft comprises first and second shafts each arranged for drivingly supporting at least one core, whereby a web may be wound upon a core upon a shaft or upon a core upon the other shaft, the first and second shafts having their axes parallel and spaced from a further parallel axis around which the pair of shafts are rotatable, a knife member carried by the centre shaft and being mounted for movement from an inoperative position to an operative position, whereby rotation of the pair of shafts about the further axis causes the web being wound on to a core on one of the shafts to contact an empty core on the other of the shafts and whereby movement of the knife member into the operative position subjects the moving web to increased tension so as to sever it between the respective cores to allow further winding of the web on to the empty core.

According to a preferred embodiment of the invention, the knife member is mounted for pivotal movement about an axis located intermediate and parallel to the respective shafts axes such that the cutter element of the knife member pivots about such axis from the inoperative to the operative position.

In the apparatus of the invention, the knife members are arranged to point, in their inoperative position, either towards the full or the empty core, depending upon the winding arrangement being used. In one preferred form, the knife member is arranged to pivot about its axis from the inoperative to the operative position so that the cutter element moves in the same sense as the web. In another preferred form, the knife member is arranged to pivot about its axis from the inoperative position so that the cutter element moves in the opposite sense to the web. Generally, the first arrangement is preferred, but the other can be preferable in certain circumstances as explained below.

According to an especially preferred feature of the invention, a pair of knife members are provided with their pivot axes adjacent and disposed one on either side of the further axis about which the pair of shafts can rotate, the pair of knife members being mounted for equal and opposite pivotal movement so that severance of the moving web is effected by the knife member located on the side where the moving web extends from the wound to the empty core.

Preferably, the pair of core-winding shafts are associated with a frame mounted for intermittent rotation, as desired, about the further axis, each shaft being independently rotatable of the other and being separately removable from and returnable to the frame for loading cores thereon or removing them therefrom, without preventing continued rotation of the other shaft of the pair.

According to another preferred feature of the invention, the knife members are operated pneumatically, piston and cylinder units serving to move the knife members from one position to the other and vice versa, control of such piston and cylinder units being effected in timed relation to rotation of the pair of shaft members when change-over from winding on to one shaft to winding on to the other shaft is to be effected.

According to a particular feature of the invention, the core change-over arrangement is associated with a web slitter/re-winder section comprising means for slitting a wide web into a plurality of narrower webs which are guided alternately to one of two rewind units each comprising a pair of shafts arranged to drive winding cores and the two rewind units being drivingly coupled so as to effect rotation of their parts of shafts about the respective axes simultaneously, whereby re-winding of all the narrower webs changes over from a first set of cores to a second set of cores simultaneously.

In order that the present invention may be fully understood by those skilled in the art, preferred embodiments thereof are described below, by way of illustrative example only, in conjunction with the accompanying drawings, in which:

FIG. 3 shows a detail of the part of the machine shown in FIG. 2, illustrating the electromagnetic clutches and the drive for the core shafts;

FIG. 3A is a sectional view of a part of one of the core shafts showing the core mounting and drive arrangements;

FIG. 4 to 6 show in end view one re-wind unit of the slitter/re-winder section, the unit being shown in three different states in changing over from re-winding on the shaft of the unit to re-winding on to the other shaft, wherein:

FIG. 4 shows the arrangement of the parts immediately prior to the change-over, when the cores on to which re-winding is taking place are almost filled;

FIG. 5 shows the arrangement at the instant when the unit has effected a half revolution and both the full and empty cores are being driven and the knives have been operated to cut the rewound web between the respective shafts;

FIG. 5A shows an alternative arrangement to that of FIG. 5, at the same stage in a core change-over operation, FIG. 5A showing an arrangement in which the cutter element points towards the full core in its inoperative position and so pivots in the same sense as the direction of movement of the web when moving into the operative position to effect cutting;

FIG. 6 shows the arrangement immediately after the change-over, when re-winding is taking place on to the empty cores and the full cores are ready for removal from the machine;

The cut-off knife arrangement of the invention can be incorporated in a wide variety of machinery for handling webs, where winding or re-winding takes place on to one or more winding or re-winding cores mounted upon a driven shaft, which itself is mounted within a frame carrying a second drivable shaft. This common and convenient arrangement allows the machine operator to wind on to one shaft, to load one or more empty cores on to the other shaft and, at the desired time, interchange the shafts so as to continue winding and allow the full core or cores to be removed for storage, transport or further processing of the webs wound thereon. The invention is illustrated in the accompanying drawings as part of a printing and slitting machine, illustrated in FIG. 1. This machine is used to print a monochrome or multi-colour design in bands on a wide web, which is then slit between the printed bands to produce a number of printed narrow webs which are intended for use in wrapping small articles. For example, tubes or columns of confectionery items can conveniently be wrapped in small lengths of such narrow webs, which have been printed with the appropriate design employed by the confectionary manufacturer to identify such items.

Figure 1A:
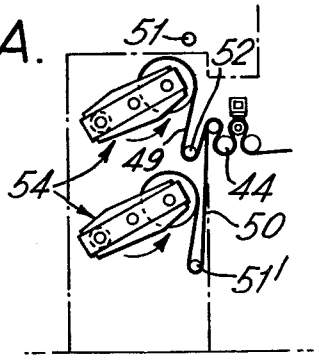
FIG. 1A is a view resembling that of FIG. 1 showing the slitter/re-winder section only with a modified web feeding arrangement.
Figure 1:
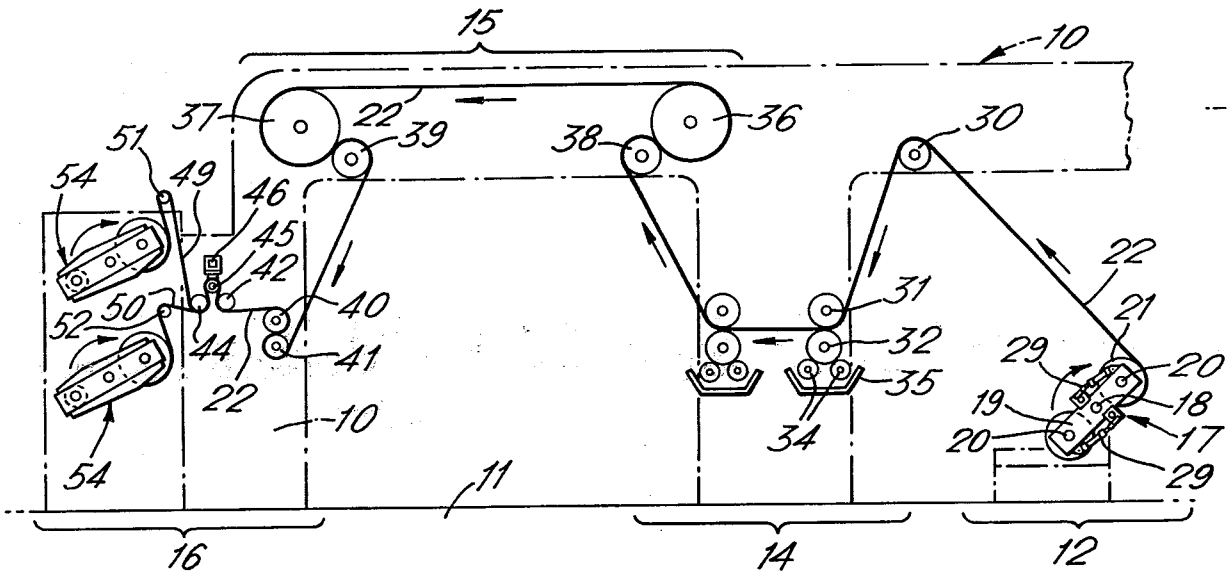
FIG. 1 shows in diagrammatic side elevational view the main components of a machine for subjecting a wide paper or other web to a sequence of operations, including printing, drying, slitting and re-winding, the cut off knife arrangement of the present invention being incorporated in the slitter/re-winder section of the machine.

Referring to FIG. 1, the machine comprises a frame, indicated diagrammatically at 10 and essentially comprising a pair of similar side frames connected together upon a floor 11 and having the machine components suitably mounted between such side frames. These components comprise a wide web off-wind section 12, a printing section 14, a drying section 15 and a slitter/re-winder section 16. The off-wind section 12 comprises a sub-frame 17 comprising a centre shaft 18 connected at each end to an end plate, one of which is shown at 19, and between the two end plates 19 a pair of shafts 20 are mounted, one on either side of the sub-frame shaft 18. Each shaft 20 can be removed from and replaced in the sub-frame 17 when not in use, by manually-actuable bearing means not shown in detail. A wide web in the form of a reel 21 is mounted upon each of the shafts 20 and the web 22 is taken from one reel 21 and trained through the machine in the direction indicated by the arrows. In operation, off-winding of the web 22 takes place under the control of an electromagnetic or other brake (not shown) incorporated in the respective shaft 20.

Figure 12:
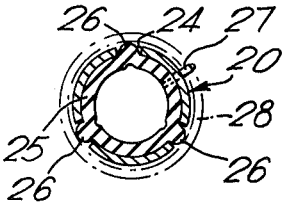
FIG. 12 shows a cross-sectional view of one of the core-driving shafts incorporated both in the off-winding section for feeding the wide web to the machine and in the slitter/re-winder section.

The detailed construction of the latter is illustrated in FIG. 12. The shaft 20 is tubular and provided along its length with spaced longitudinal slots, one of which is indicated at 24. A heavy rubber or other resilient expansible sleeve 25 is located with the tube forming the shaft 20 and the sleeve 25 has projections 26 upon its surface which register with the slots 24. The projections 26 are dimensioned so that they are flush with or below the surface of the shaft 20 until the interior of the sleeve 25 is connected, as by a line 27, to a source of compressed air (not shown), when the sleeve 25 expands and the projections 26 stand proud of the shaft surface. This enables the inside of a tubular core 28 on which the web 22 is wound to be gripped by the projections, so that with the air disconnected the core is freely slidable on to and off the shaft 20 and with the air connected the reeled web on the core is rotationally coupled to the shaft 20. Off-winding of the web 22 can thus be controlled or stopped by operation of the aforementioned brake associated with the shaft 20. The off-winding section also includes cut-off knife mechanisms, indicated generally in FIG. 1 at 29, which serve to sever the off-running web as the leading end of a new web is attached to it when changing over from a nearly empty reel to a full one. Operation of these arrangements is similar to those incorporated in the slitter/re-winder section and will be described below in relation thereto.

From the off-winding section 12, the web passes to the printing section 14 by being trained over an idler roller 30, the printing section being represented in FIG. 1 as two similar units each comprising an upper roller 31 and a lower roller 32 having the web 22 passing through the nip between them, the lower roller 32 being contacted by applicator rolls 34 disposed above a trough 35. The printed web 22 leaves the section 14 and passes to the drying section 15 comprising first and second dryer drums 36, 37 each of which contacts a counter roller 38, 39 so that that web 22 passes round the roller 38 and through the nip between it and the first drum 36 and then to and round the second drum 37 and through the nip between it and the roller 39. The printed web 22 delivered from the section 15 is printed with a number of continuous bands of printed design, the individual bands being of pre-determined width. It is therefore necessary, in order to re-wind the web 22 in the form of separate bands, to slit the web into these bands and to re-wind them as separate reels. This is done in the slitter/re-winder section 16 illustrated in FIGS. 1 and 1A, and shown in detail in FIGS. 2 and 3.

Figure 10:
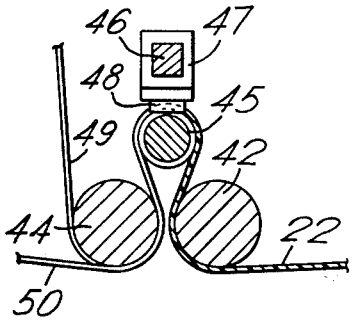
FIGS. 10 and 11 show, in vertical cross-section and end elevation respectively, details of the slitter unit incorporated in the machine of FIG. 1.
Figure 11:
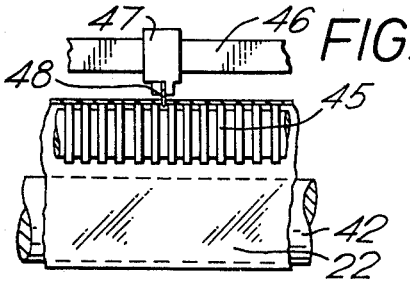

A vertical pair of rollers 40, 41, the lower roller being driven, receive the web and pass it to a spaced horizontally-arranged pair of idler rollers 42, 44 (see also FIGS. 10 and 11). Above the gap between the latter rollers is located a grooved slitter roller 45. A mounting bar 46 runs across the machine above the slitter roller 45 and any desired number of knife mounts 47 each carrying a downwardly-directed slitter knife 48 can be clamped in position along the bar 46. The spacing between adjacent knives 48 can be any desired multiple of the individual groove width of the slitter roller 45 and the actual spacings are selected to suit the individual band widths printed on the web 22 in the section 14. Each knife 48 rides in the appropriate groove in the slitte roller so that, as the web passes from the roller pair 40, 41 to the first of the horizontal rollers 42, up over the slitter roller 45 and then down to the second of the horizontal rollers 44, it is slit into the pre-arranged individual printed bands, indicated at 49 and 50. Instead of the slitter roller 45, a fixed pad of felt can be employed to back the web 22 against the knives 48. This allows the knife positions to be infinitely adjustable and reduces knife wear, which can be considerable with a grooved slitter roller when a knife has to be located closely adjacent a side wall of a groove. The individual printed bands 49, 50 are taken from the roller 44 alternately up, as the bands 49, to an upper idler roller 51 and down, as the bands 50, to a lower idler roller 52, each of the rollers 51, 52 being associated with a re-wind unit indicated generally at 54. It will be seen from FIG. 1 that the printed bands are fed to the rewind units 54 so that the printed bands are fed to the rewind units 54 so that the printed surfaces of the bands face outwardly as they are wound in the units. To allow the bands to be wound appositely, that is, with the printed surfaces facing inwardly on the cores, an idler roller 51′ can be provided instead of the roller 51, or in addition to this roller if winding in either sense is to be selectively available. The path of the bands 49, 50 to the rewind units 54 when use is made of the roller 51′ is shown in FIG. 1A. The two units 54 are identical in construction and operation and only one of the units 54 is therefore described.

Figure 2:
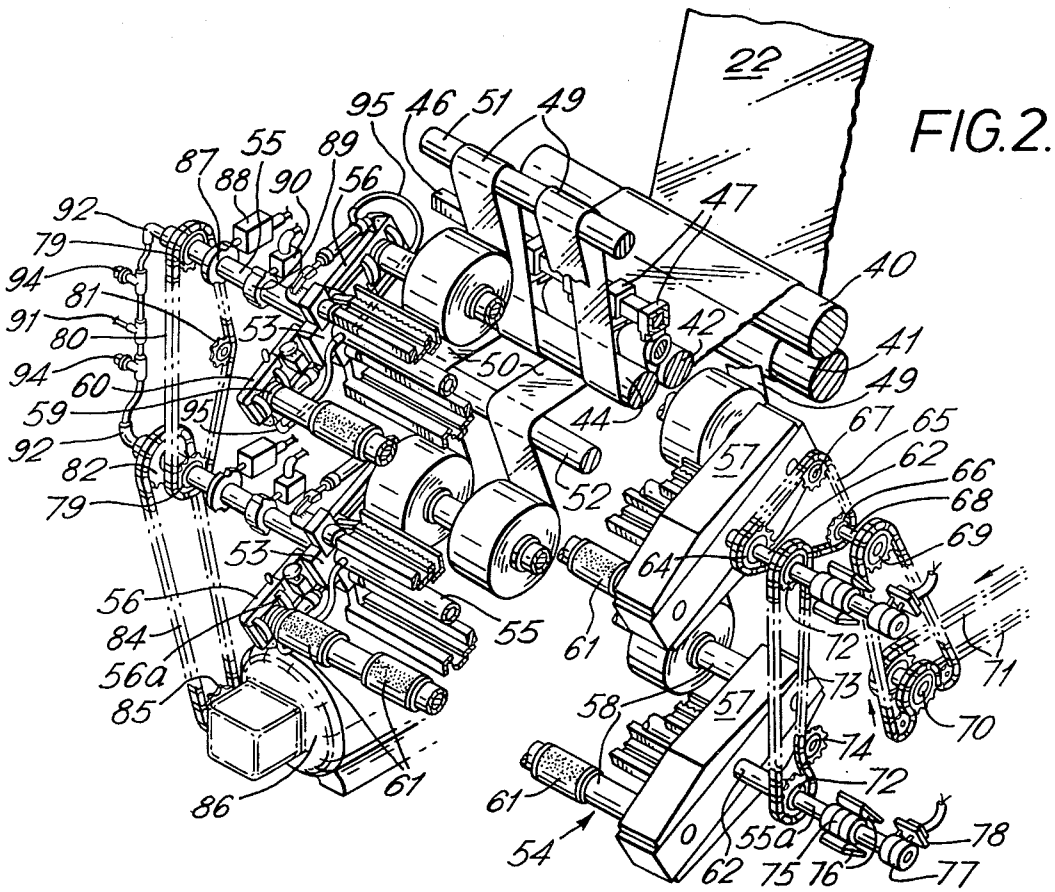
FIG. 2 shows in perspective view, partly broken away, the slitter/re-winder section of the machine in FIG. 1.

Referring to FIGS. 2, 3 and 3A, each unit 54 comprises a central tubular shaft 55 which, near one end, passes through and is secured to a frame plate 56 and, near the other end, is secured to a box-like housing 57. The shaft 55, plate 56 and housing 57 form a unit which supports the other components of the re-wind unit 54 and which can rotate about the axis of the shaft 55, which is mounted for this purpose in bearings 53 carried by the aforesaid opposed side frames of the machine frame 10 (FIG. 1). Each unit 54 includes a pair of core driving shafts 58 which have their respective ends journalled in bearings provided in the inside faces of the frame plate 56 and the housing 57, the bearings in the plate 56 being shown in FIG. 2 at 59. The bearings (shown at 58*a*, FIG. 3) for the ends of the shaft 58 in the housing 57 are such that the shafts 58 can be readily removed and replaced, once catch members associated with the bearings in the plate 56, one of which members is shown at 60, have been operated to allow the bearings 59 to be opened to allow the shaft ends journalled on the plate 56 to be removed or replaced.

A desired number of narrow web re-wind cores 61 can be readily loaded on to the shaft 58 at appropriate positions when the shaft is removed from the unit 54, the positions of the cores axially of the shaft being determined by tubular spacers 58*d* on the shaft. As shown in FIG. 3A, each end of each core is received on an annular flange of a brass ring 58*c* extending axially into the core from a radial flange of the ring which abuts the core end. A felt washer 58*f* is sandwiched between the outer side of each brass ring and an adjacent clutch washer 58*g* which is arranged to be driven by the shaft 58. The drive from the shaft 58 is transmitted to the clutch washers by means of an internally projecting lug 58*g* on each washer which is received in a keyway 58*j* provided in the shaft. At one end of each shaft there is provided a cam mechanism 56*a* which is manually operable to urge a spacer received on the end of the shaft 58 towards the other end of the shaft. A compression ring 58*k* is received on the shaft between the end spacer and the adjacent spacer and operation of the cam mechanism 56*a* applies resilient pressure axially along the various components received on the shaft so that the rotational drive of the shaft is applied to the brass rings and thus to the cores through the clutch washers and the felt washers. Release of the cam mechansim 56*a* releases the pressure between the clutch washers and the brass rings so that the cores 61 can rotate freely relative to the shaft. Even when the clutch mechanism is engaged, the cores 61 are free to slip slightly relative to the clutch washers and this facility is essential in practice to allow for variations in the radial thickness of the slit bands wound on the cores due to variations in the thickness of the web 22 along the length of the reel 21.

Within the housing 57, as shown in FIG. 3, each shaft 58 is connected to one part of an electromagnetic clutch 58*c* the other part of which is connected to a shaft 58*n* which is aligned with the shaft 58 and carries a sprocket 58*b*. A hollow shaft 62 projects from the housing 57 and is journalled on a coaxial extension shaft 55*a* extending from the shaft 55. The extension shaft 55*a* is itself hollow and contains wiring extending between ring contacts 75 towards the outer end of the extension shaft and the electromagnetic clutches 58*c*. The ring contacts 75 co-operate with fixed brush contacts 46 and the arcuate extent of the ring contacts determines the condition of the clutches in dependence on the angular position of the housing 57 and thus of the shafts 55 and 55*a*. The shaft 62 carries sprockets 62*a* within the housing 57 connected by chains 62*b* to the sprockets 58*a*. Each shaft 58 is thus rotated to drive the cores 61 which it carries by rotation of the extension shaft 62, the coupling between the shafts being by the chain and sprocket drives, 62*a*, 62*b*, provided the associated electromagnetic clutch 58*a* is closed so as to transmit the drive from the shaft 58*n* to the shaft 58. Outside the housing 57, the shaft 62 carries a sprocket 64 which is driven by a chain 65 trained round a drive sprocket 66 and a chain tensioner 67. The sprocket 66 in turn is driven via a shaft 68 and a drive sprocket 69 connected by a chain reverse drive 70 to the main drive chain 71 coupled to the main motor (not shown) which supplies driving power to the rollers of the machine. A further sprocket 72 keyed to the shaft 62 adjacent the sprocket 64 serves to couple the shaft 58 of the upper unit 54 to that of the lower unit 54, a chain being trained round the sprockets 72 and controlled by an outside tensioner 74. The chain 71 is driven constantly and is so able to drive either or both of the shafts 58 in each unit 54, so as to rotate the cores 61, depending upon whether the associated electromagnetic clutches 58*c* are opened or closed. In normal operation, the shaft 58 in each unit 54 nearer the slitter unit (as shown in FIGS. 1, 1A and 2) is driven whilst the other shaft 58 is idle.

At the opposite side of the machine, the central shaft 55 of each unit 54 extends beyond the frame plate 56 and carries a sprocket 79, the two sprockets 79 being connected by a chain 80 having a tensioner sprocket 81. This couples the frames of the two units together so that they are always positioned identically in driving and during change-over. The end of the shaft 55 of the lower unit 54 also carries another sprocket 82 which is connected by a chain 84 to the output 85 of an electric motor 86. The latter is operated intermittently as required, in order to subject each unit 54 to a half revolution at the time of change-over, as explained in more detail below.

A start swich is closed to energise the motor 86 when changeover is desired, and a cam 87 on one of the shafts 55 actuates a micro-switch 88 to stop the motor when the units 54 have been rotated together through 180°. As indicated by the arrows in FIG. 1A, the units 54 must be rotated in the opposite direction to effect changeover when the bands 50 are taken over the idler roller 51′ and to allow changeover in either direction to be selected, a control switch for reverse drive of the motor is provided and the cam and microswitch arrangement is duplicated on the other of the shafts 55, the second microswitch being effective to stop rotation of the units in the reverse direction only.

Between the frame plate 56 and sprocket 79, each shaft 55 also carries a cam 89 associated with an actuator 90 for controlling admission of compressed air to pneumatic piston and cylinder units (described below) in accordance with the rotation of the units 54 so that cut-off knives are operated to sever the bands 59, 60 being wound on to the cores 61 on one of the shafts 58 in each frame and allow re-winding to transfer to the cores 61 on the other shafts 58. FIG. 2 also shows an air-line 91 connected by way of branches 92 to the insides of the hollow shafts 55, the branches 92 including restrictors 94 actuate by the cams 89 and the associated mechanisms, so as to connect a compressor air source feeding the line 91 to and to disconnect it from the knife mechanisms incorporated in the frame plates 56. The shafts 55 are closed at their ends adjacent the housings 57 and the air-line 91 is thus in communication with air-lines 95 connected into each shaft 55 adjacent the plate 56. Each line 95 is coupled to a pneumatic cylinder 96 having a piston 97. Each unit formed by a cylinder 96 and piston 97 is mounted with its cylinder end hingedly connected to a bracket 98 secured to the frame plate 56, whilst its piston end is hingedly secured to a link lever 99. The latter is in turn connected to one end of a bar 100 pivotally mounted in a bearing 101, also secured to the frame plate 56, and having its other end pivotally mounted in a similar bearing (not shown) mounted within the housing 57. The bar 100 thus extends entirely across the unit 54 parallel to the centre shaft 55 and, under the control of the cylinder 96 and piston 97, can pivot between two positions in its bearings. The bars 100 and the associated parts are also shown in FIGS. 4 to 6. In order to provide for cutting of the narrow web irrespective of which shaft 58 its core 61 is being driven by, the frame plate 56 carries a unit comprising the bar 100 and associated parts on either side. Each bar 100 has a serrated knife blade 102 attached to it by means of an intermediate plate 104 and a fixed angle iron guard 105 extends across the unit 54 and surrounds the knife blade 102 on one side and at the edge, when the blade 102 is in its out-of-use position, shown in FIGS. 2, 4 and 6. The guard 105 is secured to the plate 56 at one end and to the housing 57 at the other end.

Figure 7:
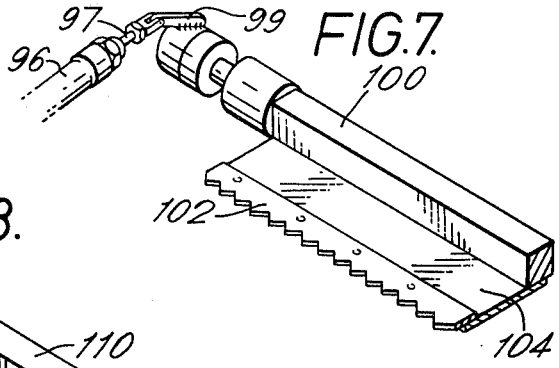
FIG. 7 shows a perspective view of the knife incorporated in the re-wind unit of FIGS. 3 to 5.

The detailed construction of the bar 100, the intermediate plate 104, the knife blade 102 and their connection to the piston 97 and cylinder 96 is shown in FIG. 7.

Figure 8:
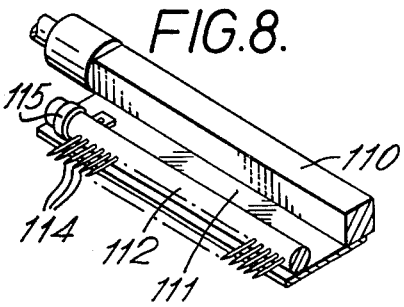
FIGS. 8 and 9 show perspective views similar to FIG. 7 of two different alternative forms of knife or cutter for use when webs are being processed which require a different form of knife from that shown in FIG. 7.

FIG. 8 shows an alternative mechanism for cutting the re-wound web. This includes a pivotable bar 110 similar to the bar 100 and like it mounted for pivotal movement about its longitudinal axis by a piston and cylinder unit such as 96, 97. The bar 110 supports an elongated plate 11 having a rod 112 secured to its free edge by means of straps 115. This has a series of pointed spikes 114 carried on it, the points being aligned and directed away from the axis of the bar 110. Operation of the cutter of FIG. 8 is similar to that of FIG. 7 and it is suited for use with webs which tear when perforated.

Figure 9:
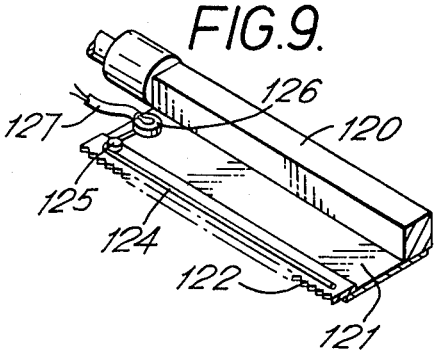

FIG. 9 shows a further form of cutter, again comprising a pivotable bar 120 carrying on it a plate 121. The free edge of the latter supports a finely-serrated blade 122, which has studs such as 124 near each end. These studs support an electrically-heatable wire 125, the ends of which are secured to terminals, one of which is shown at 126, which are attached to the respective ends of the plate 121. Electrical supply to the wire 125 is provided by leads 127 which are connected to ring contacts 77 on each shaft **55*a* and co-operating brush contacts 78, shown in FIG. 2, so that energisation of the wire 125 takes place in dependence upon rotation of the units 54 and pivotation of the cutter mechanism into position to sever the web being wound. The arrangement of FIG. 9** is suitable when slitting and re-winding thermoplastic webs which can be cut by application of a hot wire.

In operation, the machine is set up for use by mounting the desired printing plates on the printing section rollers 31 and adjusting the knife mounts 47 correspondingly, so that the individual patterns printed in bands on to the web 22 in the section 14 are slit and separated in the slitter/re-winder section 16. A new web 22 in the form of a reel 21 is mounted on each of the shafts 20 and the web 22 from the reel 21 to be used is trained through the machine as shown in FIG. 1. The empty cores 61 (FIG. 2) on the shafts 58 are located at the respective positions required and a dab of adhesive is applied. The leading ends of the slit narrow bands trained respectively over the rollers 51 and 52 are attached to the adhesive on the cores 61 and operation proceeds. Prior to exhaustion of the off-running web 22 from the reel 21, the end of the unit 17 is rotated and the leading end of the new web is spliced to the old web.

When the cores 61 on the shafts 58 on to which the webs 49, 50 are being re-wound are nearly full, the change-over sequence of the invention is operated, as illustrated best in FIGS. 4 to 6. Actuation of the change-over mechanism is effected by operation of the control switch which energises the motor 86. This drives the chain 84 to cause each of the units 54 to effect half a revolution, as shown by the arrow 130 in FIG. 4. The actuators 88 are operated as the cams 87 rotate so that during a portion of the half revolution determined by the cam profile, compressed air is admitted via the lines 92 to the cylinders 96. This causes the pistons 97 to extend and, by reason of the pivotal links 99, the bar 100, 110 or 120 and the knife mounted on it is pivoted from the position shown in FIG. 4, where the knife edge 102, row of spikes 114 or hot wire 124 is adjacent the guard 105, to the position shown in FIG. 5. The knife mechanisms are both erected in this way, by reason of the duplicated construction, and so whichever is underneath as a result of the half revolution, which terminates shortly after the position shown in FIG. 5, moves into the path of travel of the web 131 from the full reel 132 on the core 61 to the empty core 61'. This has had adhesive applied to it and, as the web 131 severs, the new leading end 134 (FIG. 6) becomes wrapped upon the core 61' and re-winding continues there. Severance of the web 131 occurs in the position shown in FIG. 4, i.e. shortly before completion of the half revolution, as shown in FIG. 6. The shaft 58 on which the wound cores such as 61 are mounted has thus moved to the more accessible position shown at the extreme left of FIG. 1. The machine operator can then remove the shaft 58 by opening the catch members 60, whereupon the reels 132 can be removed and replaced by empty cores 61, the shaft 58 then being returned to its position in the machine ready for the next change-over cycle. When this occurs, severance of the web 131 is effected by the other knife 102, so that each knife 102 effects each other cutting step.

The arcuate length of the ring contacts 75 is such that the core 61' begins to rotate slightly before contact with the slit band occurs, to ensure prompt take-up of the band, and the core 61 continues to rotate for a short while after severence of the band to help wind on the severed end. The electromagnetic clutches 58*c* are thus both energised for a short time on changeover, the drive to the shaft carrying the full cores 61 being then stopped to allow removal of the shaft 58 carrying these cores.

FIGS. 4 to 6 show an arrangement in which each knife points towards the full core in its inoperative position, just before pivoting into the operative position to effect cutting. This means that the direction of pivotation of the knife is counter to the direction of travel at the web, which is thus pulled over and away from the actual cutting edge. FIG. 5A shows the alternative arrangement, in which the knife points towards the empty core in its inoperative position and so pivots in a direction which is the same as the direction of advance of the web. This means that the moving web is pulled on to the knife and becomes cut very quickly and cleanly. When the arrangement of FIGS. 4 to 6 is used instead, as may be necessary for instance if the web has been printed differently, the application of increased tension may be required for a time longer and so the restrictors 94 in the air-lines 91 maintain the knives in their forward, or operative, positions for the appropriately longer times.

I claim:

1. A core change-over arrangement for a turret machine having a center shaft, which arrangement comprises first and second shafts each arranged for drivingly supporting at least one core, whereby a web may be wound upon a core upon one shaft or upon a core upon the other shaft, the first and second shafts having their axes parallel to and spaced from a further parallel axis around which the pair of shafts are rotatable, a knife member carried by the center shaft and being mounted for pivotal movement about an axis located intermediate and parallel to the axes of the said first and second shafts, such that the cutter element of the knife member pivots about such axes from an inoperative position to an operative position, whereby rotation of the pair of shafts about the further axis causes the web being wound on to a core on one of the shafts to contact an empty core on the other of the shafts and whereby movement of the cutter element of the knife member into the operative position subjects the moving web to increased tension so as to sever it between the respective cores to allow further winding of the web on to the empty core.

2. An arrangement according to claim 1, wherein the knife member is arranged to pivot about its axis from the inoperative to the operative position so that the cutter element moves in the same sense as the web.

3. An arrangement according to claim 1, wherein the knife member is arranged to pivot about its axis from the inoperative to the operative position so that the cutter element moves in the opposite sense to the web.

4. An arrangement according to claim 1, wherein a pair of knife members are provided with their pivot axes adjacent and disposed one on either side of the said further axis about which the first and second shafts can rotate, the pair of knife members being mounted for equal and opposite pivotal movement so that severance of the moving web is effected by the cutter element of the knife member located on the side where the moving web extends from the wound to the empty core.

5. An arrangement according to claim 1, wherein the said first and second shafts are associated with a frame mounted for intermittent rotation, as desired, about the further axis, each shaft being independently rotatable of the other and being separately removable from and returnable to the frame for loading cores thereon or removing them therefrom, without preventing continued rotation of the other shaft of the pair.

6. An arrangement according to claim 1, wherein the cutter element of the knife member comprises a plate having a serrated edge disposed parallel to the axis of pivotation of the knife member.

7. An arrangement according to claim 1, wherein the cutter element of the knife member comprises a series of spikes having aligned points directed away from the axis of pivotation of the knife member.

8. An arrangement according to claim 1, wherein the cutter element of the knife member comprises a heatable wire disposed parallel to the axis of pivotation of the knife member.

9. An arrangement according to claim 1, wherein the knife member is operated pneumatically, piston and cylinder units serving to move the knife member from one position to the other and vice versa, control of such piston and cylinder units being effected in timed relation to rotation of the pair of shaft members when change-over from winding on to one shaft to winding on to the other shaft is to be effected.

10. An arrangement according to claim 1, wherein each of the first and second shafts carries a friction clutch means for driving each of the cores received thereon.

11. An arrangement according to claim 10, in which each said friction clutch means comprises a mounting ring engaging each end of the core, a clutch washer at each end of the core, the clutch washers having keys received in a keyway in the shaft so as to be rotatable therewith, and a friction washer between each mounting ring and the adjacent clutch washer, means being provided for selective application of pressure axially of the shaft to effect driving engagement between the clutch washers and the mounting rings through the friction washers.

12. An arrangement according to claim 1, wherein two centre shafts are provided for synchronous operation, the first and second shafts associated with one centre shaft serving to wind alternate webs slit from a wide web and the first and second shafts associated with the other centre shaft serving to wind the other webs slit from the wide web, whereby synchronous operation allows change-over of all cores simultaneously.

* * * * *